United States Patent [19]

Stuart

[11] Patent Number: 4,942,433

[45] Date of Patent: Jul. 17, 1990

[54] FIXING METHOD AND APPARATUS

[75] Inventor: Paul O. Stuart, Pittsford, N.Y.

[73] Assignee: Eastman Kodak Company, Rochester, N.Y.

[21] Appl. No.: 352,237

[22] Filed: May 15, 1989

[51] Int. Cl.[5] ..... G03G 15/20; G03G 21/00

[52] U.S. Cl. ..... 355/284; 355/282; 118/60; 118/258; 118/260; 118/268

[58] Field of Search ..... 355/284, 285, 282, 326; 430/99, 124; 118/260, 256, 267, 268, 60

[56] References Cited

U.S. PATENT DOCUMENTS

| | | | |
|---|---|---|---|
| 4,045,165 | 8/1977 | Nakajima et al. | 118/60 X |
| 4,193,681 | 3/1980 | Tanigawa et al. | 355/284 |
| 4,272,666 | 6/1981 | Collin | 355/284 X |
| 4,359,963 | 11/1982 | Saito et al. | 118/60 |
| 4,393,804 | 7/1983 | Nygard et al. | 118/60 |
| 4,541,707 | 9/1985 | Yoshinaga | 355/284 |
| 4,549,803 | 10/1985 | Ohno et al. | 355/284 |
| 4,565,762 | 1/1986 | Kato | 355/284 |
| 4,593,992 | 6/1986 | Yoshinaga et al. | 355/284 |
| 4,668,537 | 5/1987 | Matsuyama et al. | 118/60 X |
| 4,743,943 | 5/1988 | Adams, Jr. et al. | 355/284 |
| 4,757,347 | 7/1988 | Tamaoki et al. | 355/284 |

FOREIGN PATENT DOCUMENTS

| | | | |
|---|---|---|---|
| 54-103051 | 8/1979 | Japan | 355/284 |
| 0075351 | 4/1985 | Japan . | |
| 0176075 | 9/1985 | Japan . | |

*Primary Examiner*—Fred L. Braun
*Assistant Examiner*—Matthew S. Smith
*Attorney, Agent, or Firm*—Leonard W. Treash

[57] ABSTRACT

A release liquid applying device of the known rotating wick type engages and is rolled by a fusing roller as it applies liquid to the roller. When resin based stock is used, a brake prevents rotation of the wick by the roller. This reduces the oil applied and reduces a tendency the rolling wick has to leave a pattern of locally excessive liquid in the oil on the roller.

9 Claims, 2 Drawing Sheets

FIXING METHOD AND APPARATUS

FIELD OF THE INVENTION

This invention relates to methods and apparatus for fixing toner to a receiving sheet, and more specifically to such methods and apparatus in which a release liquid, for example, a silicone oil, is applied to the surface of a roller which contacts the toner image to prevent offset of toner onto that surface. The invention is particularly usable in a color printer or copier in which color toner images are fixed to resin based materials, for example, transparent materials, as well as to paper based materials.

BACKGROUND OF THE INVENTION

U.S. Pat. No. 4,429,990 issued Feb. 7, 1984 to E. J. Tamary shows a pressure roller fuser of a type presently commercially used to fix toner images to support sheets. An important aspect of that disclosure is a mechanism for applying release liquid to a fusing roller which contacts the toner image. That liquid applying mechanism, commonly called a rotating wick, includes a hollow porous roller, which is supplied with fusing oil internally. The applicator has an inner supply tube with holes in it and is covered by a porous material having a surface of wool or a heat resistant synthetic wicking material. The applicator is rotatable by the fusing roller. Because the applicator rotates with the roller, the wick thoroughly applies the liquid with a minimum of wear to the roller. The applicator is movable into and out of engagement with the roller according to a program which prevents excess buildup of oil on the roller which otherwise would stain the image bearing sheet. This general type of structure is relatively inexpensive to manufacture and is effective in applying oil to rollers, both of the type in which oil is applied to one roller and also the type shown in the patent where the oil is supplied by separate wicks to both rollers.

However, because the wick structure directly contacts the roller and rolls with it, it has a tendency to leave the liquid in a fine pattern consisting of spots of locally excessive liquid. These spots may impede transfer of heat energy from the fusing roller to the toner. With ordinary paper support sheets, the release liquid is quickly absorbed and the spots of excess liquid have no adverse effect. Resin based stock, for example transparency stock, does not absorb the liquid and small spots of incomplete fusing can result. These spots are not generally noticed when black toner is used on transparencies. However, even a small amount of incomplete fusing of a color transparency will show up as gray or black spots in a projected color image using that transparency. The present tendency of the art is to use very viscous silicone oils as the release liquid has increased this problem of local excessive liquid.

A number of references show approaches to improving fusing oil control and fusing transparency; see for example U.S. Pat. Nos. 4,549,803 and 4,593,992. In both these patents fixing conditions are changed when the sheet carrying the toner image is synthetic resin rather than paper. To improve fixing for transparency stock, an obvious solution is to slow the fixing apparatus down or increase the temperature to thereby apply more fusing power to each unit of area to be fused. Obviously, if transparency stock absorbs less release liquid, the amount of liquid applied must be reduced as well. In these two patents this is accomplished by articulating a wick that applies release liquid to an application roller or by control of various spreading and cleaning devices in the system. These patents deal only with the problem of excess liquid on transparencies in general not with the problem of locally excessive spots of liquid imparted by the wicking structure itself.

The Tamary patent is representative of a number of other patents which show articulating wicks for pressure roller fixers; see for example U.S. Pat. Nos. 4,008,955; 4,045,165 and 4,272,666.

Commonly-assigned U.S. Patent Application Ser. No. 223,829 to Mills et al entitled "Fixing Method And Apparatus," filed July 25, 1988 discloses a solution to this latter problem of locally excessive spots of liquid imparted by the wicking structure as well as the problem of generally excess liquid on transparency stock. According to that application, the rotatable wick is moved out of engagement with the roller surface a sufficient time prior to contact of the transparency with that surface to give surface tension on the liquid an opportunity to eliminate locally irregular excesses of liquid. In addition, a sheet of paper stock can be run through the fuser to both spread and absorb liquid prior to fusing a transparency.

This method has been shown to be extremely effective in both reducing the total amount of liquid applied to the transparency and in removing local excesses of liquid. However, despite its quality advantages it inherently slows the fusing process by increasing the necessary time between sheets.

SUMMARY OF THE INVENTION

It is the object of this invention to improve the productivity of a release liquid application method and apparatus generally of the type described above.

This and other objects are accomplished by a method and apparatus, which method includes the steps of applying release liquid directly to a roller surface by engaging the surface with a wicking surface generally of the type which ordinarily rolls with the surface which method is characterized by the steps of determining whether the recording sheet is paper based or resin based and if the sheet is resin based preventing said wick from rotating with the roller surface to force the wick to slide on the roller surface, while if said sheet is paper based permitting the wick to roll with the surface.

It has been found that if the wick is prevented from rolling with the roller, it does not apply as much liquid to the roller, and there is no pattern imparted to the liquid on the roller surface. This is ideal for fusing transparencies. However, for fusing images on paper stock, where the liquid is substantially absorbed by the paper, the greater liquid applying ability associated with the rotating wick is preferred.

Apparatus constructed according to the invention includes in addition to the structure shown in the prior art a brake or other rotation preventing mechanism associated with the rotatable wick selectively actuatable to prevent rotation of the wick when the apparatus is in its transparency fusing mode.

DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
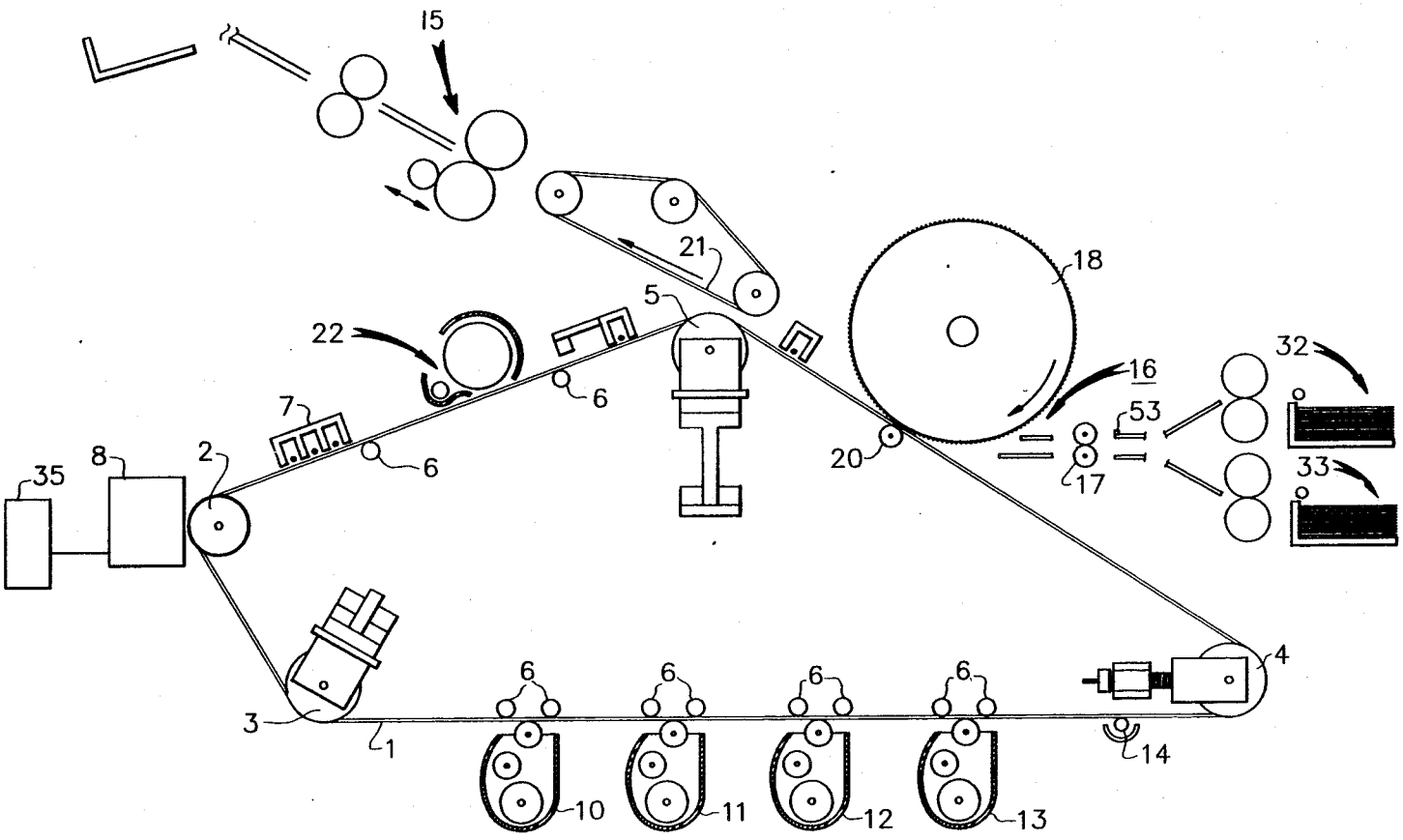
FIG. 1 is a schematic side view of a printer or a copier constructed according to the invention with parts eliminated for clarity of illustration.

According to FIG. 1, a film core portion of a copier or printer includes an endless movable web, for example an electrophotographic web 1 entrained about a series of primary rollers 2, 3, 4 and 5 and other supporting structure, for example, film skis 6.

The web is driven through a series of electrophotographic stations generally well-known in the art. More specifically, a uniform charge is laid down on the electrophotographic web 1 at a charging station 7. The uniformly charged web moves around printhead roller 2 which is directly opposite an LED printhead 8 which LED print head exposes the web 1 in a manner well known in the art. The web then moves into operative relation with a series of toner stations 10, 11, 12, and 13. Each image created by exposure is toned by one of the toner stations. After being toned, the web passes a magnetic scavenger 14, which removes excess iron particles picked up in the toning process. After the electrostatic image has been toned, the web passes to a transfer station 16 where the image is transferred to a transfer surface. The transfer surface is one surface of a copy sheet which has been delivered by a copy sheet feeding mechanism 17 to the transfer station 16. The transfer station 16 includes a transfer drum 18 to which the copy sheet is secured for repeated presentations to web 1.

When the apparatus is operating in a multi-color mode consecutive images or pairs of images are toned with different colored toners using the different toning stations 10–13. These consecutive images are transferred in registry to the transfer surface as it repeatedly is brought into transfer relation with the web 1 by the drum 18. After the transfer operation is complete, the copy sheet is allowed to follow the web, for example by removing a vacuum holding it to the drum or by stripping the sheet with a claw or other conventional stripping mechanism, not shown. The copy sheet is separated from the web with the aid of a sheet transport mechanism 21 and is transported to a fixing device 15, more thoroughly described below. The web is then cleaned at cleaning station 22 and the process repeated.

Figure 2:
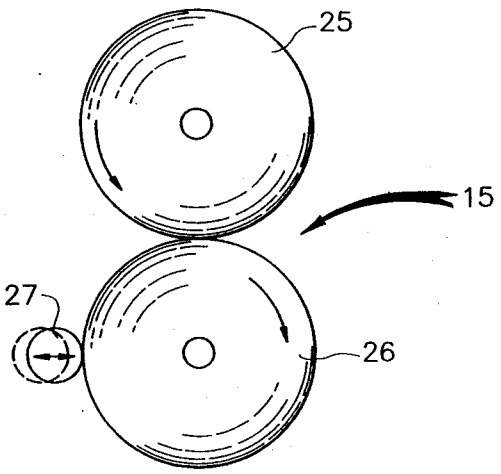
FIG. 2 is a side view of a fixing device constructed according to the invention and usable in the printer or copier shown in FIG. 1.

The fixing device 15 is a roller fuser similar to that shown in U.S. Pat. No. 4,429,990, Tamary, discussed above, disclosure of which patent is incorporated by reference herein. Referring to FIG. 2, the fixing device or roller fuser 15 includes a pressure roller 25 and a fusing roller 26. The fusing roller is heated and is intended to contact the toner bearing surface of the copy sheet. At least one of the rollers is soft enough to create a nip of sufficient length that the combination of heat and pressure fixes the toner to sheets passing through the nip, all as is well known in the art.

Figure 3:
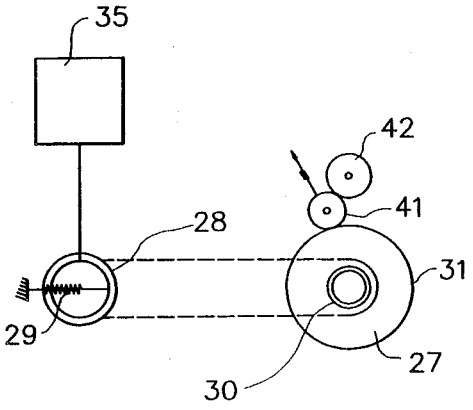
FIG. 3 is a side schematic view of a wick articulating and control structure constructed according to the invention.

A rotating wick 27, similar to that shown in said Tamary patent, is mounted for articulating movement as shown in FIG. 2 into and out of engagement with the fusing roller 26. As shown in FIG. 3, and as is described in more detail in said Tamary patent, articulation of the rotating wick is accomplished by an air bladder 28 and retraction spring 29. As air is supplied to the air bladder 28 the wick 27 is moved against the urging of retraction spring 29 into engagement with the roller 26. As air is removed from the air bladder 28, the retraction spring disengages the wick from fusing roller 26. Alternatively, a set of cams or other known device can be used to articulate the wick. The wick itself is of complex construction. It includes a distribution tube 30 through which a viscous release liquid, such as silicone oil, is pumped. The release liquid passes through holes in the distribution tube 30 to a fabric covering 31. If needed, an intermediate porous material, not shown, can be positioned between the tube 30 and the fabric covering 31 to help spread the liquid. The porous materials permit the viscous liquid to spread, applying it sufficiently evenly to the fusing roller for normal operation. However, local spots of excess liquid do result on the fusing roll due to the irregular texture of the fabric and imperfections in the distribution system. The fabric itself may be wool, or other natural fabric. However, the most common material used is a heat resistant synthetic fabric marketed by DuPont under the trade name NOMEX.

According to the above-mentioned Tamary patent, the rotating wick is articulated according to a program that applies the liquid to the fusing roller 26 prior to the entry of the first sheet carrying a toner image into the nip and continues that application until a logic and control unit determines that there has been a buildup of release liquid to a point beyond which staining and other problems associated with insufficient fusing might occur. At this point the logic and control unit shown in Tamary releases the air pressure in the air bladder 28 thereby disengaging the wick for a period of time or copy sheet count at which point it is reengaged. This mode of operation is desirable for use in the apparatus shown in FIG. 1 when operating with images carried on ordinary paper sheets and is a first mode of operation of this apparatus. However, when transparency stock, especially with color toner images, is passed through the fuser, the irregular fabric surface of the wick leaves a pattern in the release liquid on the fusing roller of excessive liquid in certain spots. Those spots show up as gray or black when the transparency is projected because of scattering of light by inconsistently fused toner.

To solve this problem, it has been found that if the rotating wick 27 is prevented from rotating with roller 26 while in engagement with it, less liquid is applied to roller 26 and that liquid does not contain the pattern imparted by the wick surface. Accordingly, as shown in FIG. 3 a braking roller 41 is selectively engageable with the surface of rotating wick 31 by cam 42. Braking roller 41 is normally spring urged out of engagement with wick 27 and stays out of engagement as long as the apparatus is fusing images on paper stock. However, when the apparatus is fusing images on transparency stock, cam 42 is rotated to the position shown in FIG. 3 to force braking roller 41 into engagement with surface 31 of rotating wick 27. This engagement prevents rotation of wick 27 and causes both less oil to be deposited on the surface of roller 26 and that oil to be deposited in a manner that does not create localized excesses from the wick fabric.

Referring to FIG. 1, an optical sensing device 53 is positioned in the path of the receiving sheets to detect whether or not the receiving sheet is transparent. Based on that determination it is assumed that if the receiving sheet is transparent, it is constructed of resin based stock and if not transparent that it is paper stock. Accordingly, if it is determined that the sheet is paper based, when the sheet approaches fuser 15, cam 42 is rotated or left in a position not urging braking roller 41 into engagement with wick 27. Wick 27 is thereby permitted to roll with the surface of fusing roller 26 and substantial liquid is applied to that surface. If sensor 53 senses that the receiving sheet is transparent, it assumes that it is resin based, and when the receiving sheet approaches the fuser 15 cam 42 is rotated to the position shown in FIG. 3 urging braking roller 41 into engagement with rotating wick 27 to prevent rotation of wick 27 with the surface of roller 26, thereby imparting a reduced amount of liquid to that surface and imparting it in a manner which is more uniform and does not have localized areas of increased liquid.

Alternatively, the determination that the receiving sheet to be passed through the fuser is paper based or resin based can be input manually by the operator. This would ordinarily be done by a switch that was labelled "transparency". Both a transparency button and an automatic sensing device such as device 53 are generally known in the art for controlling various aspects of such apparatus, including the fuser.

For some applications, for example, with particularly difficult to fuse toners, it may be advisable to combine this invention with the one disclosed in the Mills application mentioned above. For example, the operator could control a switch having a choice between "paper", "black toner image transparency" and "color toner image transparency". When the switch is set to "paper", the device would operate with the wick in rolling engagement with the surface of roller 26. When either of the transparency positions are selected, brake 41 would be moved to the position shown in FIG. 3 to prevent rotation of the wick 27 while in engagement with the roller 26. When the color transparency position is picked, in addition to preventing rotation of the wick 27, paper based sheets may be automatically fed through the fuser between transparency sheets to remove excess oil even further.

Another variation of this latter approach would use the intervening sheets for only multicolor transparencies where the build up of more than one color toner makes the excess oil most damaging. Black and monocolor transparencies would then be fused with the wick braked, but without interleaved paper stock.

The invention has been described in detail with particular reference to a preferred embodiment thereof, but it will be understood that variations and modifications can be effected within the spirit and scope of the invention as described hereinabove and as defined in the appended claims.

I claim:

1. A process of fixing color toner images carried on a receiving sheet using a fixing device of the type having at least one roller having a surface which contacts the toner image during fixing, said process including the step of engaging said surface with a release liquid applying wick to apply release liquid thereto, said wick being of a type having an irregular fabric surface that is rotatable with the roller surface, characterized in that said process further includes the step of determining both whether the receiving sheet is paper based or resin based and, if resin based whether the image to be fixed is composed of black toner or one or more color toners, if said sheet is resin based and contains one or more color toners, preventing said wick from rotating with said roller surface to force said wick to slide on said roller surface, and if said sheet is paper based permitting said wick to roll with the roller surface.

2. The process according to claim 1 wherein said determining step includes the step of optically sensing whether a receiving sheet is resin or paper based prior to said sheet reaching said fixing device.

3. The process according to claim 1 wherein said determining step is accomplished by manually inputting an indication of the type of receiving sheet to said device.

4. The process according to claim 1 wherein if said receiving sheet is resin based and contains one or more color toners said process includes the step of contacting said roller surface with a sheet of material more absorbent of said liquid than said resin based sheet prior to contact of the toner image for fixing.

5. A printer or copier of the type in which dry toner is applied to a receiving sheet in image configuration and then fixed by a fixing device, which copier includes means for forming images of at least one color other than black on transparent resin based stock, and which fixing device includes:

a pair of rollers which contact each other to form a nip and rotate during fixing to drive a toner carrying sheet through the nip, a rotatable wick for applying a viscous release liquid directly to the surface of one of said rollers, said wick having an irregular surface which engages said roller, and means for preventing rotation of said wick by said roller, said fixing device having first and second modes of operation in which:

in said first mode said wick is permitted to rotate with said roller surface, and in said second mode said wick is prevented from rotating with said roller surface.

6. A printer or copier according to claim 5 including means for determining whether a receiving sheet is paper based or resin based, and means for setting said device to operate in its first mode as said determining means determines that a receiving sheet to be fixed is resin based.

7. A printer or copier according to claim 6 wherein said determining means is an operator settable device.

8. A printer or copier according to claim 6 wherein said determining means includes a means for optically sensing the opacity of a receiving sheet.

9. A fixing device of the type having a movable surface which contacts a receiving sheet, a rotatable wick for applying a release liquid directly to said surface and means for preventing rotation of said wick while in engagement with said surface, said device having first and second modes of operation in which:

in said first mode said preventing means is set to prevent rotation of said wick with said surface forcing said wick to slide on said surface, and in said second mode said preventing means does not prevent rotation of said wick by contact with said surface.

* * * * *